US006276110B1

(12) United States Patent
Karlsson

(10) Patent No.: US 6,276,110 B1
(45) Date of Patent: Aug. 21, 2001

(54) STUD FOR A TIMBER WALL

(75) Inventor: Klas Karlsson, Jönköping (SE)

(73) Assignee: Sodra Timber AB, Vaxjo (SE)

( * ) Notice: Subject to any disclaimer, the term of this patent is extended or adjusted under 35 U.S.C. 154(b) by 0 days.

(21) Appl. No.: 09/529,763

(22) PCT Filed: Nov. 5, 1998

(86) PCT No.: PCT/SE98/01999

§ 371 Date: Jun. 6, 2000

§ 102(e) Date: Jun. 6, 2000

(87) PCT Pub. No.: WO99/27207

PCT Pub. Date: Jun. 3, 1999

(30) Foreign Application Priority Data

Nov. 11, 1997 (SE) ..... 9704118

(51) Int. Cl.[7] ..... E04B 2/70; E04C 3/12; B27M 3/08

(52) U.S. Cl. ..... 52/733.2; 52/730.7; 52/481.1; 52/745.19; 144/368; 144/371; 144/376

(58) Field of Search ..... 52/730.7, 733.2, 52/731.5, 233, 481.1, 745.19; 144/368, 371, 376

(56) References Cited

U.S. PATENT DOCUMENTS

| | | | | |
|---|---|---|---|---|
| 2,922,201 | * | 1/1960 | Baker | 52/481.1 |
| 3,159,235 | * | 12/1964 | Young et al. | 52/241 X |
| 3,992,838 | | 11/1976 | Vizziello | 52/233 |
| 3,999,343 | * | 12/1976 | Roberts | 52/481.1 X |
| 4,167,961 | * | 9/1979 | Paris, Jr. et al. | 144/368 X |
| 4,235,057 | * | 11/1980 | Teeters | 52/733.2 X |
| 4,344,263 | | 8/1982 | Farmont . | |
| 4,909,294 | * | 3/1990 | Gamba | 144/371 |

FOREIGN PATENT DOCUMENTS

| | | |
|---|---|---|
| 173068 | 7/1993 | (NO) . |
| 9607519 | 3/1996 | (WO) . |
| 9607802 | 3/1996 | (WO) . |

* cited by examiner

*Primary Examiner*—Laura A. Callo
(74) *Attorney, Agent, or Firm*—Ladas & Parry

(57) ABSTRACT

The present invention relates to a stud (1) intended for a timber wall and a method for manufacturing the stud (1). The stud (1) constitutes a part of a wooden frame on which, for example, plaster board panels (12) are secured in order to form the wall. The stud (1) is provided with at least two longitudinal grooves (6, 7) made alternatingly from opposing sides (2, 3) of the stud (1). Each individual groove (6, 7) is wholly open towards that side (2, 3) it was made from. Each groove (6, 7) moreover displays openings (10, 11) in the opposite side (2, 3) and portions (8, 9) with residual material between the openings (10, 11). Each longitudinal groove (6, 7) is thus alternatingly through-going and alternatingly not through-going.

9 Claims, 2 Drawing Sheets

STUD FOR A TIMBER WALL

The present invention relates to a stud for a timber wall, and also to a method for manufacturing the stud according to the preamble to the appended main claims.

The timber wall which the stud according to the present invention is intended for consists of panels, normally plaster board panels, secured on a wooden frame. The wooden frame normally consists of a sill or a ground plate at the bottom, and a top plate at the top, with studs running between them. Plaster board panels or the like are then secured on this stud frame, on one or both sides. In door openings and the like, so-called nogging pieces are also mounted between the studs. A wall of this type should, int. al., be sound insulating and thermally insulating, this latter being particularly applicable to an outer wall. Naturally, the walls should also be as configurationally stable as possible.

The present invention is based on the concept of making grooves in the stud in order to obtain improved properties as regards straightness, sound insulation and thermal insulation.

It has per se been previously known in the art to make, for different reasons, grooves in studs. But the novel feature according to the present invention resides in the manner in which the grooves are arranged as well as how they are formed.

When sound is generated on one side of a timber wall of the above-described type, the panels on that side of the wall are set in motion. If the studs are homogeneous and relatively rigid, they transmit the oscillation movement to the panel on the other side of the wall without any actual damping. A method of avoiding this sound transmission is to render the studs less homogeneous and weaker so that the oscillations are not transmitted as easily between both sides of the walls. The result of a less homogeneous and weaker stud will be improved sound insulation. In the present invention, by placing grooves alternatingly from different directions, a stud will be obtained with an approximately S-shaped cross section, the S-configuration making the stud resiliently yieldable in the direction between the panels, while the rigidity of the stud in other directions is affected to a lesser extent. Moreover, the grooves are compressed somewhat under the action of physical force, which contributes to the sound insulation properties. As a result of the improved sound insulation, in certain cases the necessity of building a thicker wall in order to give the desired sound insulation is avoided.

Wood always absorbs and gives off water to and from its surroundings depending upon the air humidity, which influences the configurational stability of the stud. When the moist ratio in the wood falls, it shrinks and when the moisture ratio rises the wood swells. These shrinkages and swellings are of different magnitude in different directions because the wood fibres lie in different directions. This in turn results in tension occurring in the wood. Many of these local tensions in the wood counteract one another, for which reason they give no visible result, but a number of the local tensions cooperate which may result in the timber becoming bent and/or warped. By providing grooves in the stud, many of the locally built-up tensions are reduced. Those tensions which remain result, after the provision of the groove, only in the width of the groove varying somewhat, which is of no importance to the function of the stud.

For example, a through-going outer wall stud often acts as a cold bridge even though wood is a relatively good thermal insulator. Air, and particularly motionless air, is however, a considerably better thermal insulator. By providing the stud with grooves according to the present invention, there is at least one air column in every conceivable cross section. This implies that the heat will have a considerably longer distance to go when it must be spread in both the longitudinal and lateral directions.

One object of the present invention has thus been to develop a stud with improved properties as regards straightness, sound insulation and thermal insulation.

Further objects and advantages according to the present invention will be apparent from the following description of one preferred embodiment. Further advantageous embodiments of the present invention are disclosed in the appended subclaims. In the accompanying Drawings:

Figure 1:
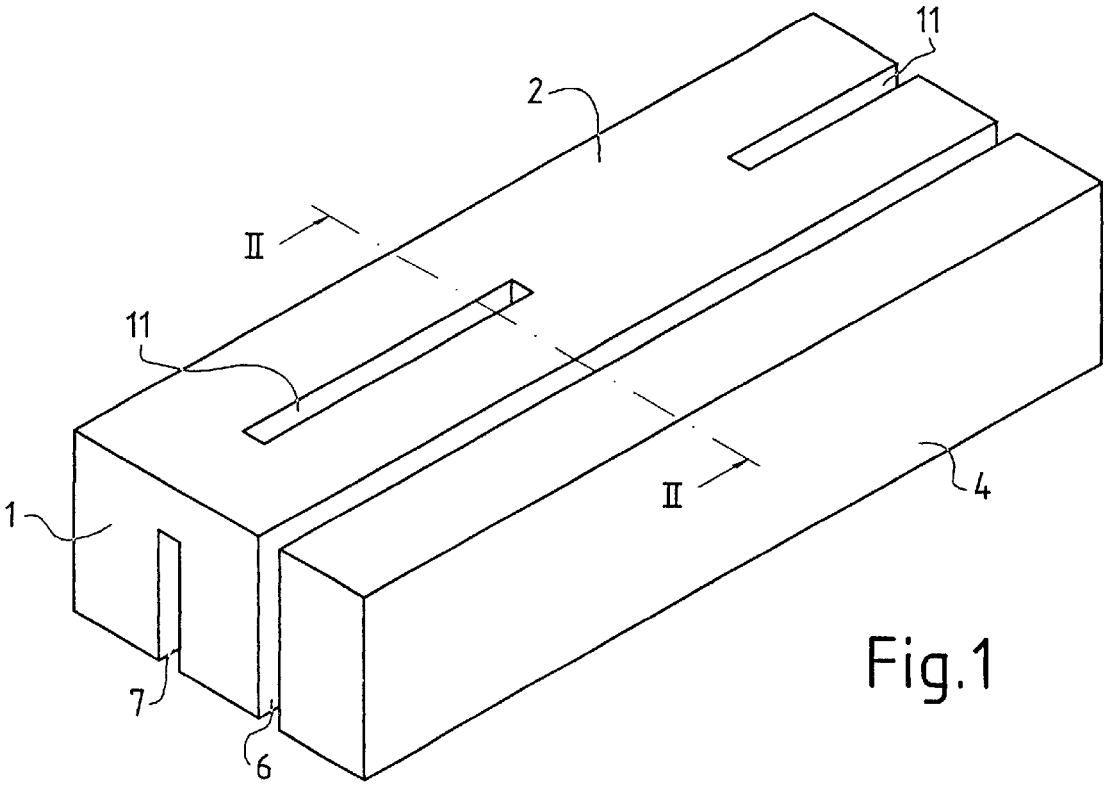
FIG. 1 is a perspective view of a section of a stud according to the present invention.
Figure 2:
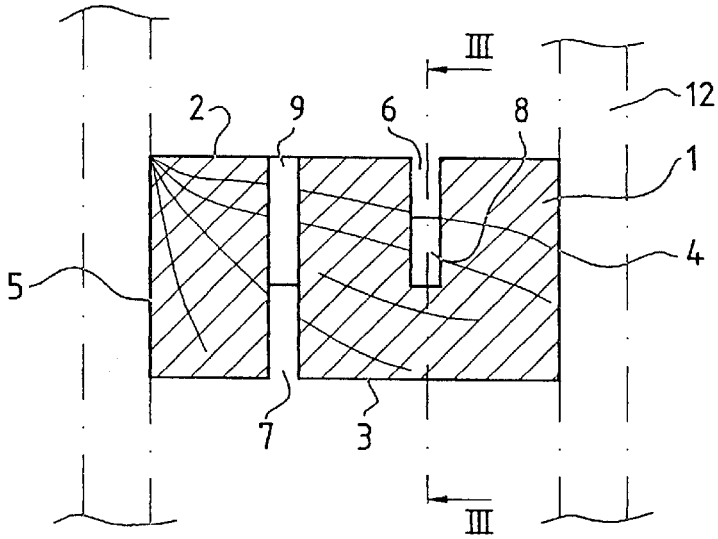
FIG. 2 is a cross section taken along the line II—II in FIG. 1, with plaster board panels intimated by broken lines.
Figure 3:
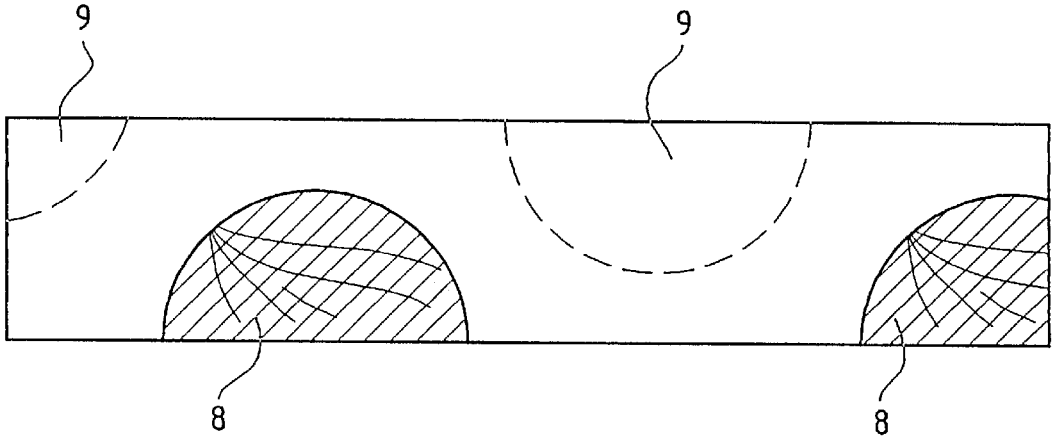
FIG. 3 is a longitudinal section taken along the line III—III in FIG. 2.
Figure 4:
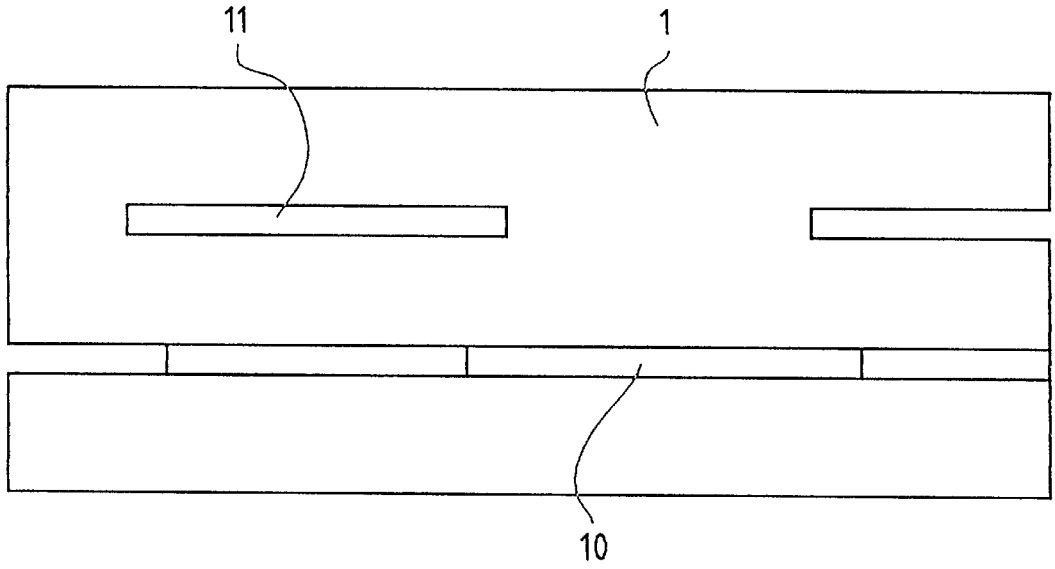
FIG. 4 is a top plan view of the stud section according to earlier Figures.

The stud 1 according to the present invention displays at least two longitudinal grooves 6,7 taken from opposing sides 2,3 of the stud. In other embodiments (not shown) more grooves are provided, where the grooves lie alternatingly from opposing sides 2,3. The grooves 6,7 are made on the sides 2,3 which are not intended to receive plaster board panels 12. When making the grooves 6,7 care should be taken to ensure that they must lie a sufficient distance from the sides 4,5 of the stud 1 in order that the screws (or nails) with which the panels 12 are secured to the stud 1 do not enter into the grooves 6,7 or at least not through the grooves 6,7. Screws which go through the grooves 6,7 risk reducing the favourable properties attained thanks to the grooves. In FIG. 2, panels 12 are intimated as secured to the stud.

The grooves 6,7 are given a configuration which is such that each groove 6,7 forms openings 10,11 on the opposing side 2,3 compared with that direction from which the grooves are made. Between these openings 10,11, the grooves 6,7 have portions 8,9 with residual material.

In the illustrated embodiment, the portions 8,9 with residual material are of curved form. These grooves have been formed in that a rotary saw blade moves up and down through the stud 1 at the same time as the stud moves in the lateral direction.

On making the grooves 6,7, the amplitude of the vertical movement of the saw blade is such that a turning point for the movement of the saw blade lies outside the lower or upper edge of the stud 1, depending upon whether the grooves 6,7 are made from above or from below. The term turning point is here taken to signify that point at which the outer diameter of the saw blade changes its vertical direction of movement. During a part of the movement of the blade, there will then be obtained an entirely open groove while, during other parts of the movement of the blade, residual portions 8,9 with material will be left in place. By varying the diameter, vertical speed and amplitude of the saw blade as well as the speed of advance of the stud, the groove configuration may be varied.

In one alternative method, the grooves are made from alternatingly each side with a saw blade operating without vertical movement, the openings in the side opposite those sides where groove has been made being milled out. The result will be in this case that the stud (not shown) will have grooves where the portions with residual material are of rectilinear form.

By coordinating the making of the grooves with planing of the stud, major production engineering advantages will be afforded.

The grooves 6,7 and the opposed openings 10,11 are given such configuration that the openings 10,11 are of a longitudinal extent which is greater than the longitudinal extent of the portions 8,9 with residual material. By way of example excellent results have been achieved when the longitudinal extent of the openings 10,11 were two to three times as long as the longitudinal extent of the portions with residual material. The fact that the openings 10,11 are of longer longitudinal extent than the portions 8,9 with residual material entails that, when two or more grooves are provided, at least one groove in each cross section has no residual material. This minimum of one groove is thus wholly open from the one longitudinal side 2 of the stud 1 to the other longitudinal side 3 in this cross section. There are cross sections where all grooves are wholly open between both longitudinal sides 2,3 of the stud 1, and there are also cross sections where one or more grooves are wholly open and one or more grooves have residual material. Taken as a whole, this implies that all cross sections of the stud 1 contain at least one wholly open groove forming an air gap.

In cross section, the residual material of the stud 1 when the grooves 6,7 have been made, forms an approximately S-shape. As a result, the stud 1 will be "resiliently yieldable" in the direction of the sound propagation from one side of the wall to the other side. The feature that the grooves 6,7 are compressed under the action of force also contributes to this resilience, in which event the major portion of the compression takes place in those parts of the grooves which have though-going openings 10,11. This entails that the vibrations in one panel 12 caused by sound waves are damped by the stud 1. With the grooved stud according to the present invention, where the grooves have through-going openings, better sound insulation will thus be achieved than if a traditional, homogeneous stud had been employed.

Since each cross section of the stud 1 includes at least one air gap, an improved thermal insulation will be obtained compared with a homogeneous stud or a stud with grooves which do not give at least one air gap in each cross section. Since heat spreads more easily in the wood than in the air, the heat will, because of the air gap, have a longer distance to travel in that it must spread longitudinally and laterally past the air gap. The result will thus be improved thermal insulation.

The groove formation 6,7 in the stud 1 reduces the local tensions in the wood which lead to configurational changes, for which reason a more configurationally stable stud will be obtained thanks to the grooves.

In the manufacture of the stud 1 according to the present invention, the starting material is, after drying, taken to a plane where the stud is planed to the desired dimensional accuracy. In connection with the planing, the grooves 6,7 are made in the stud 1 as was intimated above. The plane and the saw blade lie in sequence after one another in the direction of advancement of the stud, as a result of which grooves are made at the same time as the planing operation is carried out. In certain embodiments, several saw blades are employed simultaneously.

In the illustrated embodiment, we have taken as a point of departure a stud which is normally employed in Sweden and has the dimensions 45×70 mm. A person skilled in the art will readily perceive that the present invention may also be applied to a stud with other dimensions and other relationship between width and thickness. Thus, the present invention may be applied to all conceivable stud dimensions.

What is claimed is:

1. A method for forming grooves in a timber stud (1) which is included in a wooden frame for walls, characterized in that grooves (6,7) are made alternatingly from two opposing sides (2,3) of the stud (1), said grooves (6,7) being wholly open towards that side (2,3) from which they are made; and that each groove (6,7) is provided with through-going openings (10,11) to the opposing side (2,3) of the stud (1), whereby portions (8,9) having residual material are left between the openings (10,11).

2. The method as claimed in claim 1, characterized in that a reciprocal vertical movement is imparted to a rotary saw blade at the same time as the stud (1) is advanced in the longitudinal direction.

3. The method as claimed in claim 2, characterized in that a turning point for the movement of the saw blade in the vertical direction lies outside the stud (1).

4. The method as claimed in claim 2, characterized in that the relationship between the vertical reciprocating movement of the saw blade and the speed of the stud (1) in the longitudinal direction is such that there are formed portions with curved form in the grooves (6,7).

5. The method as claimed in claim 1, characterized in that the groove formation takes place simultaneously with planing or other processing of the timber stud (1).

6. The method as claimed in claim 1, characterized in that a plurality of saw blades operates simultaneously in order to make a plurality of grooves (6,7) at one time.

7. A timber stud (1) for use as a part in a timber frame intended to be clad with panels, characterized in that at least two longitudinal grooves (6,7) are made in the longitudinal direction of the stud (1); that the grooves (6,7) are made alternatingly from opposing sides (2,3); and that each groove (6,7) displays through-going openings (10,11) and portions (8,9) having residual material between the through-going openings (10,11) in the grooves (6,7).

8. The stud as claimed in claim 7, characterized in that the grooves (6,7) are made such that an optional cross section of the stud (1) includes at least one air gap.

9. The stud as claimed in claim 7, characterized in that portions (8,9) with residual material, between the through-going openings (10,11) in the grooves (6,7), have curved configuration.

* * * * *